US011486576B2

(12) United States Patent
Post et al.

(10) Patent No.: US 11,486,576 B2
(45) Date of Patent: Nov. 1, 2022

(54) SYSTEM AND METHOD FOR BURNER IGNITION USING SENSORLESS CONSTANT MASS FLOW DRAFT INDUCERS

(71) Applicant: Regal Beloit America, Inc., Beloit, WI (US)

(72) Inventors: Steven W Post, Centerton, AR (US); Michael K. Garrett, Bella Vista, AR (US); Vijay Dayaldas Gurudasani, Gujarat (IN)

(73) Assignee: Regal Beloit America, Inc., Beloit, WI (US)

( * ) Notice: Subject to any disclaimer, the term of this patent is extended or adjusted under 35 U.S.C. 154(b) by 355 days.

(21) Appl. No.: 16/549,441

(22) Filed: Aug. 23, 2019

(65) Prior Publication Data

US 2021/0054998 A1 Feb. 25, 2021

(51) Int. Cl.
*F23N 3/08* (2006.01)
*F23N 1/06* (2006.01)
(Continued)

(52) U.S. Cl.
CPC ..... *F23N 1/082* (2013.01); *F23N 1/062* (2013.01); *F23N 3/082* (2013.01); *F23N 3/085* (2013.01);
(Continued)

(58) Field of Classification Search
CPC ..... F23N 1/022; F23N 1/062; F23N 1/082; F23N 2227/02; F23N 2227/10; F23N 2227/04; F23N 2225/06; G23N 3/085; F23L 17/005; F23L 17/16; F23L 2900/07006; F23D 14/00; F23D 14/46; F23Q 13/02
(Continued)

(56) References Cited

U.S. PATENT DOCUMENTS 4,334,855 A * 6/1982 Nelson ..... F23N 1/065 431/20
4,340,355 A * 7/1982 Nelson ..... F23N 5/025 431/20
(Continued)

FOREIGN PATENT DOCUMENTS

CN 1509391 A * 6/2004 ..... F04D 29/4213
JP 10141633 A * 5/1998
(Continued)

*Primary Examiner* — Steven B McAllister
*Assistant Examiner* — Daniel E. Namay
(74) *Attorney, Agent, or Firm* — Armstrong Teasdale LLP

(57) ABSTRACT

A motor controller for a burner system includes an inverter that supplies current to a motor that rotates a draft inducer fan. A processor is coupled to the inverter and receives a signal from a system controller, and in response instructs the inverter to supply a first current, during a first period, to the motor to rotate the fan to produce a first mass flow through the burner system, the first mass flow having a first mass flow rate greater than a threshold to actuate a vacuum switch. The processor then instructs the inverter to supply a second current, during a second period starting at an expiration of the first period, to the motor to rotate the fan to produce a second mass flow through the burner system, the second mass flow having a target mass flow rate for normal operation of the burner.

17 Claims, 5 Drawing Sheets

(51) Int. Cl.
*F23N 1/08* (2006.01)
*F23L 17/00* (2006.01)
*F23D 14/00* (2006.01)

(52) U.S. Cl.
CPC ..... *F23D 14/00* (2013.01); *F23L 17/005* (2013.01); *F23N 2225/06* (2020.01)

(58) Field of Classification Search
USPC ..... 431/12, 6, 62
See application file for complete search history.

(56) References Cited

U.S. PATENT DOCUMENTS 4,688,547 A * 8/1987 Ballard ..... F23N 1/022 126/116 A
5,075,608 A 12/1991 Erdman et al.
5,244,147 A * 9/1993 Furukawa ..... F23N 3/002 236/15 C
5,331,944 A 7/1994 Kujawa et al.
5,455,014 A * 10/1995 Costantino ..... C23C 16/448 122/5
5,524,556 A * 6/1996 Rowlette ..... F23N 1/06 110/162
5,720,231 A * 2/1998 Rowlette ..... F23N 3/082 110/162
5,865,611 A * 2/1999 Maiello ..... F23N 5/022 126/116 A
6,082,993 A * 7/2000 O'Leary ..... F23D 14/60 431/18
6,283,115 B1 * 9/2001 Dempsey ..... F24H 9/0036 236/11
6,321,744 B1 * 11/2001 Dempsey ..... F24H 9/0036 236/11
6,419,480 B2 * 7/2002 Al-Halbouni ..... F23C 7/00 431/10
7,101,172 B2 9/2006 Jaeschke
7,626,349 B2 12/2009 Marcinkiewicz et al.
7,704,375 B2 * 4/2010 Haase ..... F24H 8/006 208/15
7,735,743 B2 * 6/2010 Jaeschke ..... F23N 5/18 236/11
8,021,143 B2 * 9/2011 Slaby ..... F23D 23/00 431/12
8,303,297 B2 11/2012 Tompkins et al.
8,497,652 B2 7/2013 Shahi et al.
8,602,772 B2 * 12/2013 Fan ..... F23N 5/006 700/274
9,032,950 B2 * 5/2015 Schultz ..... F23N 5/203 126/110 C
9,593,846 B2 * 3/2017 Kuczynski ..... F22B 35/00
10,254,008 B2 4/2019 Thompson
11,060,719 B2 * 7/2021 Andersson ..... F23N 1/022
2001/0032452 A1 * 10/2001 Kamen ..... F02G 1/044 60/520
2007/0287111 A1 12/2007 Stone et al.
2008/0124667 A1 * 5/2008 Schultz ..... F23N 5/203 431/18
2009/0111065 A1 * 4/2009 Tompkins ..... F23N 1/022 431/12
2009/0112451 A1 * 4/2009 Justice ..... G01M 15/042 701/115
2010/0112500 A1 * 5/2010 Maiello ..... F23N 3/082 431/76
2011/0065054 A1 * 3/2011 Slaby ..... F23D 23/00 431/12
2011/0203497 A1 * 8/2011 Weimer ..... F23N 3/085 110/104 R
2011/0212404 A1 * 9/2011 Fan ..... F23N 5/006 431/12
2011/0269082 A1 * 11/2011 Schultz ..... F23N 5/203 431/12
2013/0213378 A1 * 8/2013 Schultz ..... F23C 9/00 126/110 C
2013/0302737 A1 * 11/2013 Schultz ..... F24H 9/02 431/6
2014/0144355 A1 * 5/2014 Kuczynski ..... F23C 9/00 110/345
2017/0082320 A1 * 3/2017 Wang ..... F23N 5/123
2018/0180282 A1 * 6/2018 Andersson ..... F23C 10/28
2019/0360691 A1 * 11/2019 Anwar ..... F23N 3/002
2019/0383486 A1 * 12/2019 Maiello ..... F23N 1/022

FOREIGN PATENT DOCUMENTS

JP 2019211135 A * 12/2019
WO WO-2010062286 A1 * 6/2010 ..... F23N 1/022
WO WO-2018152394 A1 * 8/2018 ..... F23N 1/022
WO 2019021685 A1 1/2019

* cited by examiner

SYSTEM AND METHOD FOR BURNER IGNITION USING SENSORLESS CONSTANT MASS FLOW DRAFT INDUCERS

BACKGROUND

The field of the disclosure relates generally to draft inducers in burner systems, and more particularly, to a system and method for burner ignition using sensorless constant mass flow draft inducers.

At least some known draft inducers move air across a gas burner and heat exchanger to provide adequate air mass flow for combustion. Draft inducers generally include a fan that rotates to draw combustion gasses from a collection manifold through the burner system. Generally, as the combustion gasses move through the burner and heat exchanger, a pressure drop is produced. To ensure adequate mass flow is present prior to starting the gas burner, heating appliances generally include a vacuum switch in or near the collection manifold, or other low pressure zone, and configured to actuate, due to the pressure drop, when mass flow through the burner system reaches a certain level for safe ignition of the burner. At least some known variable speed draft inducers also include another sensor in or near the collection manifold to verify the fan is producing a sufficient mass flow rate to actuate the vacuum switch and enable the burner to operate.

At least some known fan motors operate without airflow sensors using constant mass flow techniques, where the speed of the fan is determined based on a demanded mass flow rate and a known relationship between the fan speed and motor torque. Accordingly, fan motors using constant airflow techniques do not require a sensor to measure the airflow rate. Although mass flow rate is generally computed as a function of speed and torque, a mass flow rate produced by a given speed or a given torque depends on air temperature and barometric pressure, and ultimately the density of air in the burner system. According to Bernoulli's equation, before ignition, when air is cool and more-dense in the burner system, a fan turning to produce a given mass through the burner system will produce less pressure drop across the burner and heat exchanger than during normal operation, when the air is warmer and less dense. Consequently, a constant mass flow fan my not produce sufficient mass flow rate to actuate the vacuum switch where temperature and/or barometric pressure in the burner system fluctuate over a wide range. Further, under such circumstances, the burner system will not operate. For at least this reason, available sensorless constant mass flow fan motors generally are not used in draft inducers for burner systems. A sensorless motor capable of operating a fan to generate sufficient mass flow for ignition of a burner is therefore desirable.

BRIEF DESCRIPTION

In one aspect, a motor controller for a burner system is disclosed. The burner system includes a draft inducer fan configured to draw air through an airflow path through the burner system, and a vacuum switch. The motor controller includes an inverter and a processor. The inverter is configured to supply current to a motor configured to rotate the draft inducer fan. The processor is communicatively coupled to the inverter and is configured to receive a draft inducer control signal from a system controller. The processor is configured to instruct, in response to the draft inducer control signal, the inverter to supply a first current during a first period to the motor to rotate the draft inducer to produce a first mass flow through the burner system, the first mass flow having a first mass flow rate greater than a threshold mass flow rate to actuate the vacuum switch. The processor is configured to instruct the inverter to supply a second current, during a second period starting at an expiration of the first period, to the motor to rotate the draft inducer to produce a second mass flow through the burner system, the second mass flow having a target mass flow rate for normal operation of the burner.

In another aspect, a method of operating a motor for a draft inducer in a burner system is disclosed. The motor is coupled to a draft inducer fan configured to move air though an airflow path. The method includes receiving, by a motor controller configured to supply current to the motor, a draft inducer control signal from a system controller. The method includes supplying, in response to the draft inducer control signal, a first current, during a first period, to the motor to rotate the draft inducer fan to produce a first mass flow through the burner system, the first mass flow having a first mass flow rate greater than a threshold mass flow rate to actuate a vacuum switch for the burner system. The method includes supplying a second current, during a second period starting at an expiration of the first period, to the motor to rotate the draft inducer fan to produce a second mass flow through the burner system, the second mass flow having a target mass flow rate for normal operation of the burner.

In yet another aspect, a burner system is disclosed. The burner system includes a burner, a heat exchanger, a collection manifold, a motor coupled to and configured to turn a draft inducer fan, a vacuum switch, and a motor controller. The draft inducer fan is configured to draw an airflow through an airflow path from the collection manifold, across the burner, and through the heat exchanger. The vacuum switch is configured to actuate when a mass flow rate through the airflow path is sufficient to produce a vacuum above a vacuum threshold, thereby enabling operation of the burner. The motor controller is coupled to a system controller and the motor, and is configured to receive a draft inducer control signal from a system controller. The motor controller is configured to operate the motor, during a first period, to rotate the draft inducer to produce a first mass flow through the airflow path, the first mass flow having a first mass flow rate greater than the threshold mass flow rate. The motor controller is configured to operate the motor, during a second period starting at an expiration of the first period, to rotate the draft inducer fan to produce a second mass flow through the airflow path, the second mass flow having a target mass flow rate for normal operation of the burner.

DETAILED DESCRIPTION

Implementations of the system described herein produce a draft to start a burner using a constant mass flow fan motor.

More specifically, when the ignition process is initiated, the fan motor operates at an elevated speed and mass flow to ensure sufficient airflow within the system for ignition of the burner and for actuation of the vacuum switch. After a predetermined period of time, the fan motor operates at a reduced speed and mass flow to produce a target airflow for normal operation of the burner. Additional features of the system are described in more detail herein.

As used herein, an element or step recited in the singular and preceded with the word "a" or "an" should be understood as not excluding plural elements or steps, unless such exclusion is explicitly recited. Furthermore, references to "example implementation" or "one implementation" of the present disclosure are not intended to be interpreted as excluding the existence of additional implementations that also incorporate the recited features.

Figure 1:
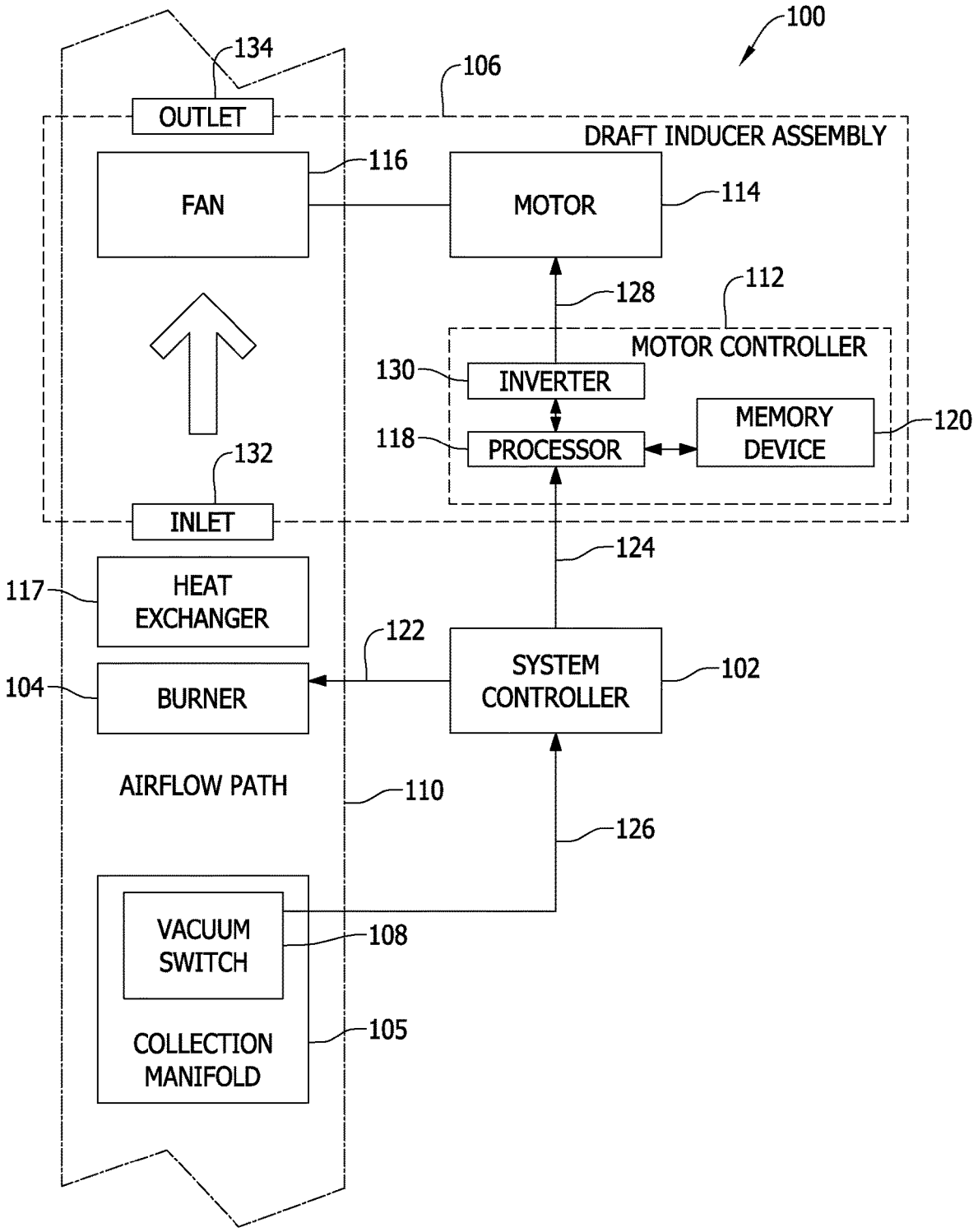
FIG. 1 is a schematic of an exemplary burner system.

FIG. 1 is a schematic of an exemplary burner system 100. Burner system 100 includes a system controller 102, a burner 104, a collection manifold 105, a draft inducer assembly 106, a vacuum switch 108, and an airflow path 110. Draft inducer assembly 106 includes a motor controller 112, a motor 114, and a draft inducer fan, or fan 116. Combustion gases are collected in collection manifold 105 prior to ignition. Generally, these combustion gasses are cool and more dense |[ZJB1]than during operation of burner system 100. Fan 116 is fluidly coupled to airflow path 110 and draws an airflow through airflow path 110 from collection manifold 105 and across burner 104 and through a heat exchanger 117. When a sufficient mass flow rate is produced, vacuum switch 108 is actuated and enables burner 104 to operate.

Motor controller 112 includes a processor 118 and a memory device 120. In some alternative embodiments, processor 118 and/or memory device 120 are physically separate from and communicatively coupled to motor controller 112.

System controller 102 is communicatively coupled to burner 104, draft inducer assembly 106, and vacuum switch 108. System controller 102 generates a burner control signal 122 to control burner 104. Burner 104 ignites, maintains, or extinguishes a gas flame based on burner control signal 122. System controller 102 also generates a draft inducer control signal 124 to control draft inducer assembly 106. The efficiency with which burner 104 operates depends on the mass flow through airflow path 110. Burner 104 is configured to operate at a target mass flow rate where burner 104 can operate safely and at a desired efficiency. While burner 104 is operating, draft inducer assembly 106 moves air through airflow path 110 at the target mass flow rate.

Burner 104 requires a mass flow rate greater than a threshold mass flow rate in order to safely ignite. Vacuum switch 108 is generally disposed in the airflow path 110 or in some other low pressure zone. Vacuum switch 108 is configured to actuate only when a vacuum pressure, produced by the mass flow induced by fan 116, at vacuum switch 108 is greater than a threshold vacuum pressure. In response to actuating, vacuum switch 108 transmits a vacuum switch control signal 126 to system controller 102 indicating the mass flow in airflow path 110 is above a threshold mass flow rate for burner 104 to safely ignite and enabling system controller 102 to instruct burner 104 to ignite.

Motor controller 112 is communicatively coupled to motor 114 and is configured to provide a current 128 to motor 114. Motor controller 112 may include, for example, a rectifier, a direct current (DC) link or bus, and an inverter 130 for generating current 128. Motor controller 112 controls one or more of frequency, amplitude, phase, or duty cycle of current 128 based on instructions from processor 118. The speed at which motor 114 turns is a function of, for example, the frequency of current 128. Accordingly, motor controller 112 can vary the speed of motor 114 by varying the frequency, amplitude, phase, and/or duty cycle of current 128.

Motor 114 is mechanically coupled to fan 116 and configured to rotate fan 116 to produce an airflow through airflow path 110 and through burner system 100 by moving air from collection manifold 105, into draft inducer assembly 106 through an inlet 132, and out through an outlet 134. The airflow has, or is characterized by, a mass flow rate. The mass flow rate through airflow path 110 depends at least on the speed and torque output of motor 114 and fan 116, and the density of the combustion gasses.

Processor 118 is configured to instruct inverter 130 to supply current 128 to turn motor 114 at a target speed (or torque) based on a specific demanded, or target, mass flow rate for burner 104. The relationship between the mass flow rate through airflow path 110 and the speed (or torque output) of motor 114 can be expressed as a formula, or "curve," defined as a function of speed, torque, and a target mass flow rate, which is sometimes referred to as a mass flow curve. The mass flow curve may be stored in memory device 120, for example, as a lookup table or an algorithm. Processor 118 determines a speed (or torque) at which to operate motor 114 for a given target mass flow based on the mass flow curve. Generally, as mass flow increases, torque output of motor 114 will increase. Accordingly, as combustion gasses are heated, the mass flow curve, or mass flow algorithm, will result in a higher speed (or torque) command for motor 114.

During the ignition process, motor controller 112 is configured to operate motor 114 at above the target mass flow rate in order to account for the reduced temperature and increased density of combustion gasses accumulating in collection manifold 105 prior to the ignition of burner 104. Because the combustion gasses in collection manifold 105 are cooler and more dense prior to ignition of burner 104, a given target mass flow of fan 116 produces a vacuum pressure at vacuum switch 108 that is less than the required vacuum pressure. Accordingly, processor 118 determines a first, or starting, mass flow rate a factor greater than the target mass flow rate, for example, a mass flow rate equal to the target mass flow rate multiplied by a factor of 1.2. Processor 118 then computes a starting speed (or torque) based on the determined starting mass flow rate using the mass flow curve and instructs inverter 130 to supply current 128 at a corresponding frequency, amplitude, phase, and duty cycle to motor 114 to operate at the starting speed (or torque). The actual mass flow rate across burner 104 and through heat exchanger 117 produced by operating motor 114 at the starting speed is a higher mass flow rate than an expected mass flow rate according to the mass flow curve, and is sufficient to actuate vacuum switch 108 and enable burner 104 to ignite when a flue temperature is low. After a period of time, 30 seconds for example, sufficient for the mass flow to actuate vacuum switch 108, ignite burner 104, and allow for heated combustion gases to reach fan 116, processor 118 then instructs motor controller 112 to supply a current 128 at a corresponding frequency, amplitude, phase, and duty cycle to operate motor 114 at the target mass rate through airflow path 110 and through burner system 100 for normal operation.

Figure 2:
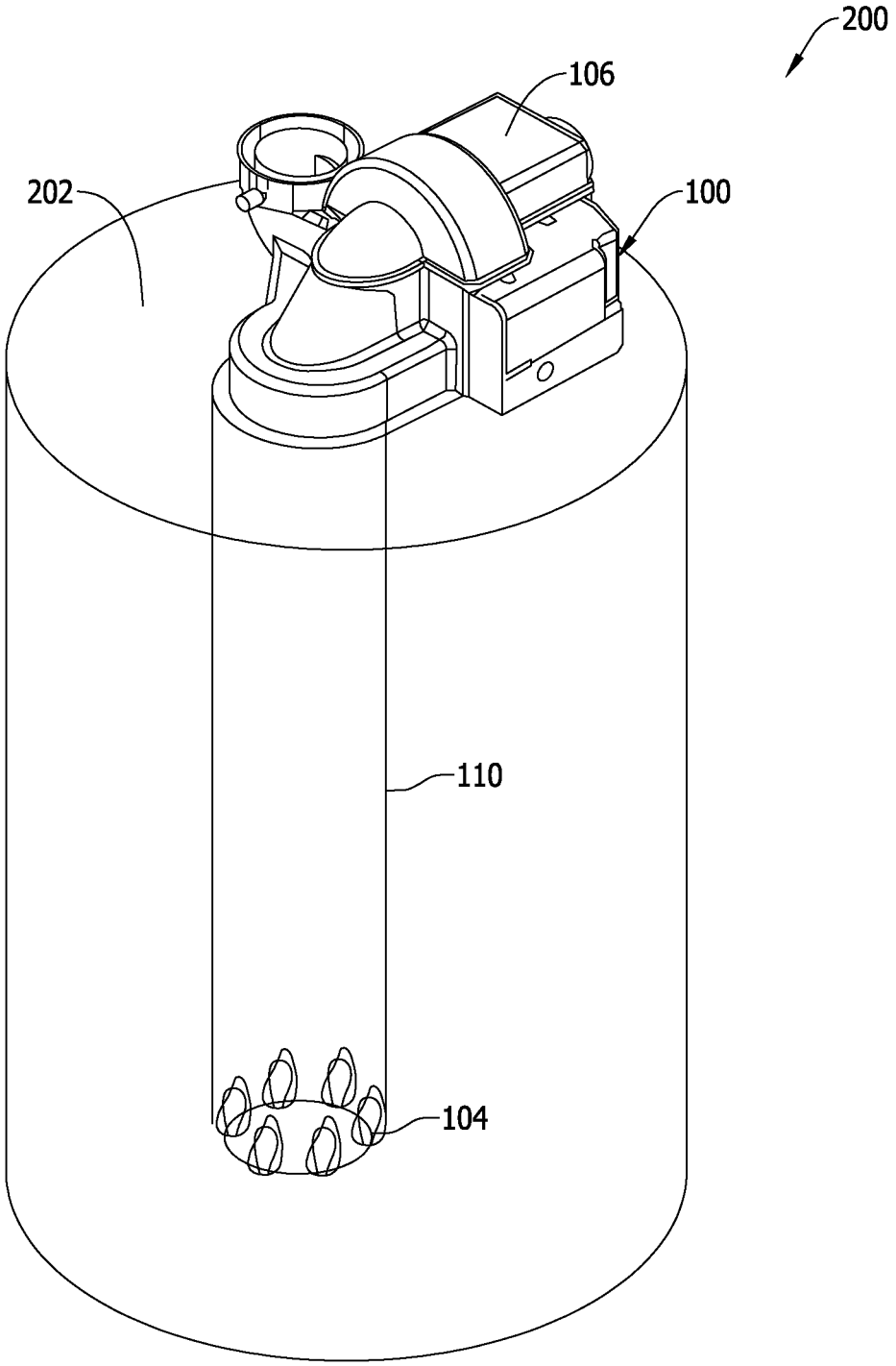
FIG. 2 is a perspective view of water heater including an example embodiment of the burner system shown in FIG. 1.

FIG. 2 is a perspective view of a water heater 200 including an example embodiment of burner system 100.

Water heater 200 includes a tank 202. Combustion gasses are exhausted through airflow path 110 and draft inducer assembly 106. The flow of air through airflow path 110 is regulated by draft inducer assembly 106. Heat transfers from air moving through airflow path 110 to heat water in tank 202.

Figure 3:
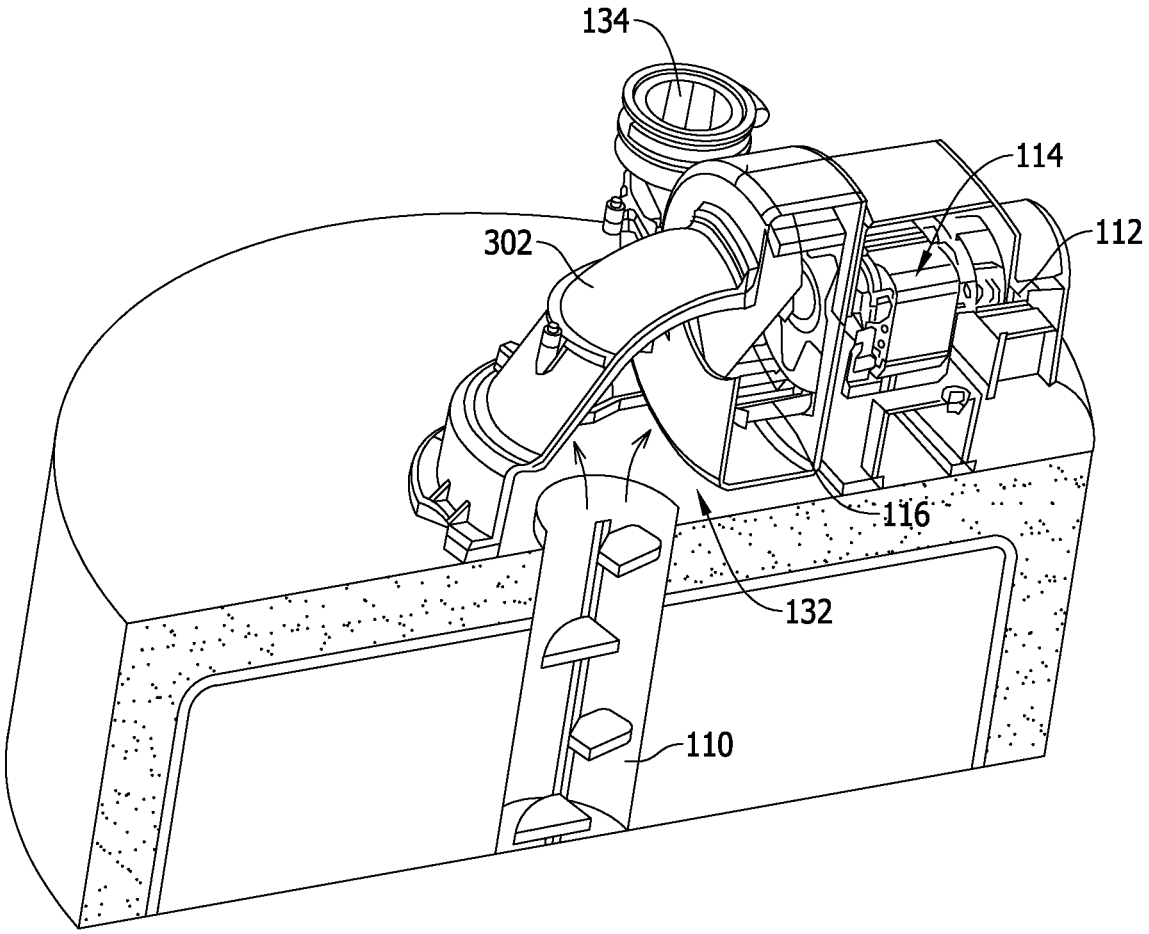
FIG. 3 is a cross-sectional perspective view of an exemplary draft inducer assembly that may be used in the burner system shown in FIG. 1.

FIG. 3 is a cross-sectional perspective view of an example embodiment of draft inducer assembly 106 that may be used in burner system 100 and water heater 200. Motor controller 112, motor 114, and fan 116 may be contained within a housing 302. Housing 302 includes inlet 132 and outlet 134 and is coupled to airflow path 110 at inlet 132. As described above, motor controller 112 supplies current to motor 114 and controls the speed of motor 114 by varying the frequency of current 128. Motor 114 rotates fan 116 to draw air in though inlet 132 and out through outlet 134, producing an airflow in airflow path 110.

Figure 4:
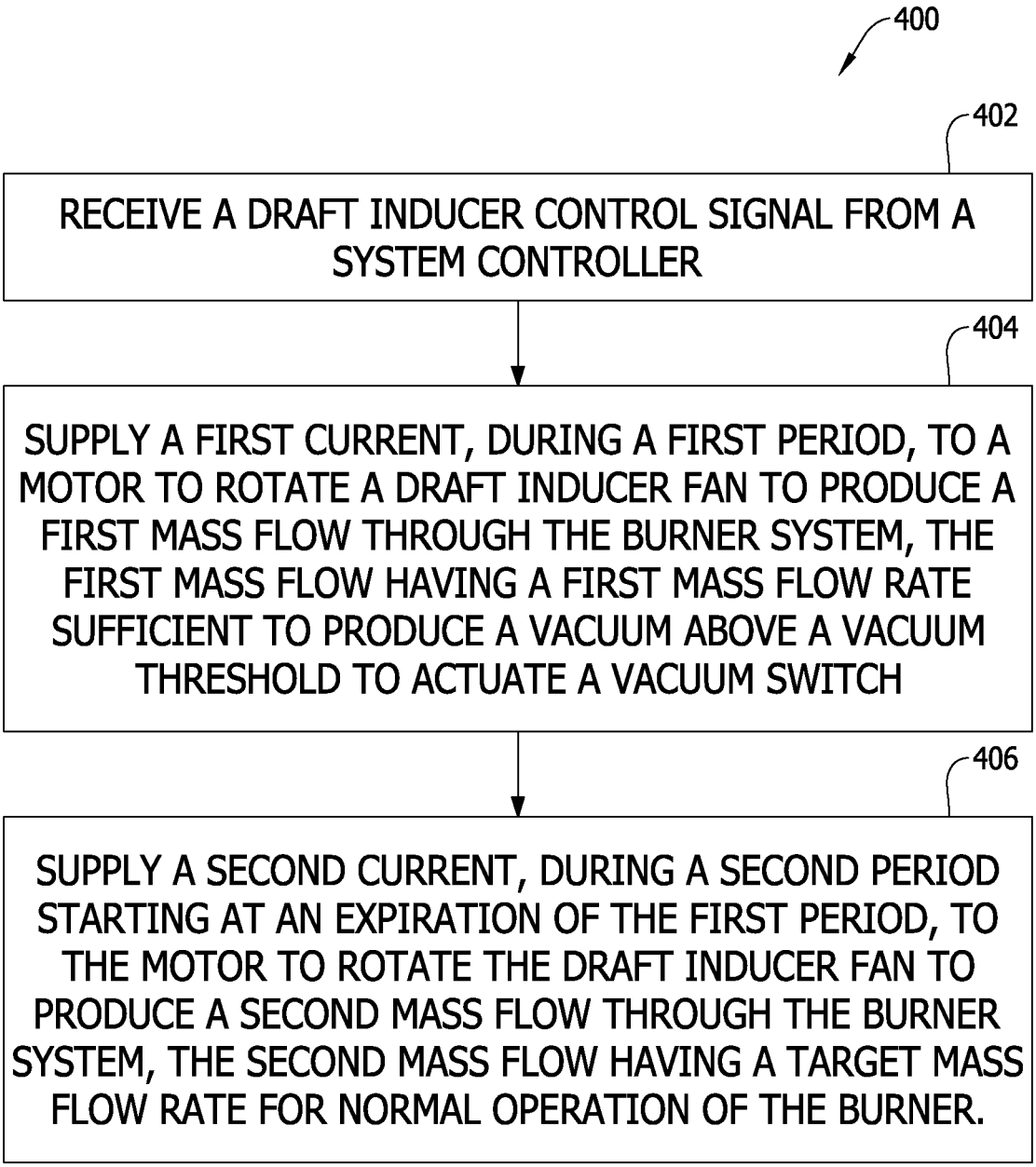
FIG. 4 is a flowchart depicting an exemplary method of operating the motor shown in FIG. 1.

FIG. 4 is a flowchart depicting an exemplary method 400 of operating a motor for a draft inducer fan in a burner system, such as motor 114 driving fan 116 in burner system 100, shown in FIG. 1. Method 400 includes receiving 402, by motor controller 112, draft inducer control signal 124 signal from system controller 102. Motor controller 112 then supplies 404, in response to draft inducer control signal 124, a first current 128 during a first period. First current 128, when supplied to motor 114, causes motor 114 to rotate fan 116 at a starting speed corresponding to a first mass flow having a first mass flow rate through airflow path 110. The first mass flow rate is sufficient to produce a vacuum above a vacuum threshold to actuate vacuum switch 108. Motor controller 112 then supplies 406 a second current 128 during a second period starting at an expiration of the first period. Second current 128, when supplied to motor 114, causes motor 114 to rotate fan 116 to produce a second mass flow having a target mass flow rate through airflow path 110. The target mass flow rate is the target mass flow rate for normal efficient operation of burner 104.

Figure 5:
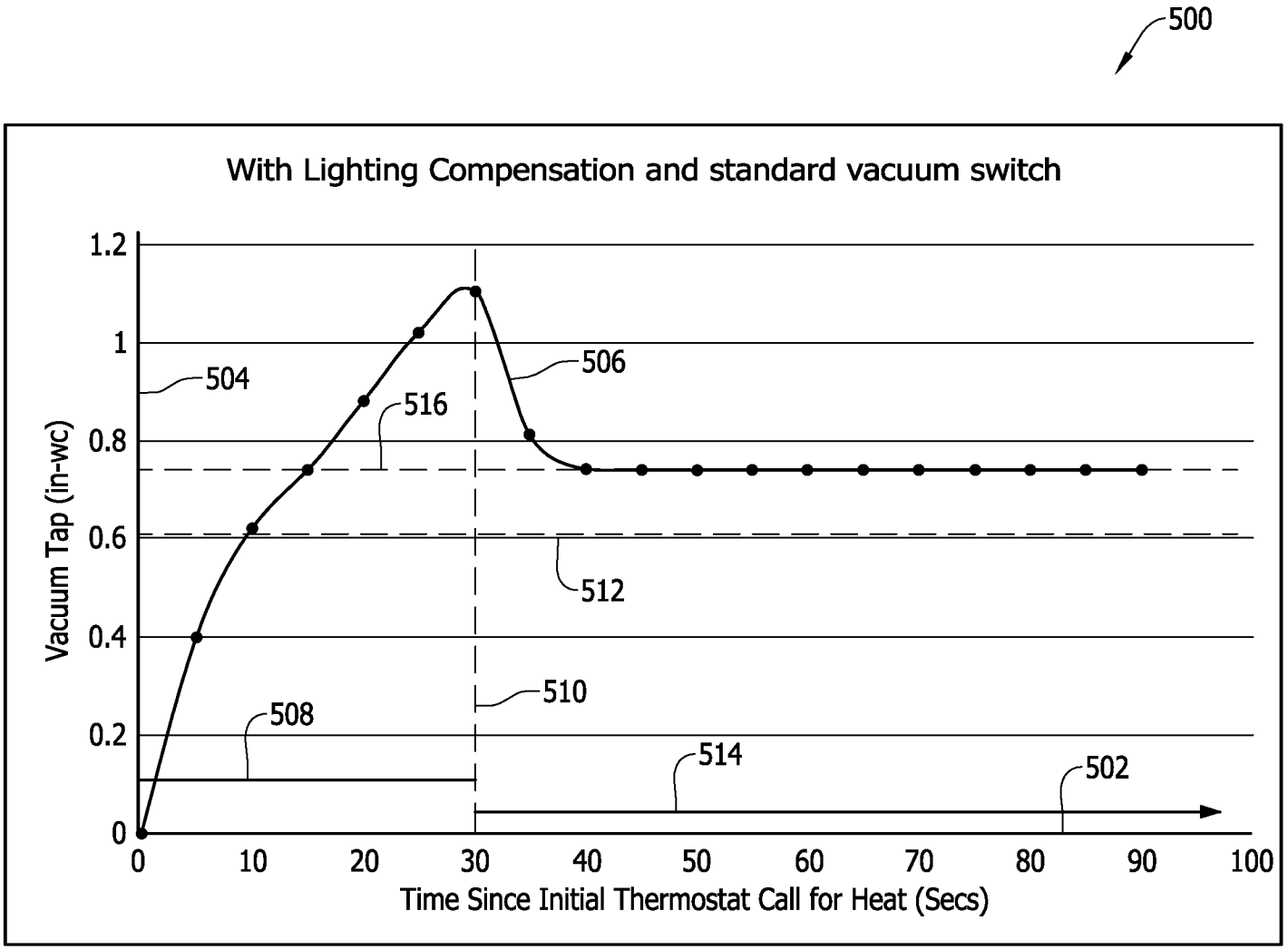
FIG. 5 is a graph illustrating an example of vacuum pressure over time during a starting process of a burner system such as the system shown in FIG. 1.

FIG. 5 is a graph 500 illustrating vacuum pressure over time during a starting process of a burner system such as burner system 100 shown in FIG. 1. Horizontal axis 502 corresponds to time elapsed from the initiation of the startup process, and is expressed in seconds ranging from 0 to 100. Vertical axis 504 represents vacuum pressure at vacuum switch 108, and is expressed in inches of water-column ranging from 0 to 1.2. Curve 506 represents the vacuum pressure at vacuum switch 108 at a given moment of time during the startup process. The vacuum pressure at vacuum switch 108 is correlated to the mass flow rate through airflow path 110.

During a first period 508 between the initiation of the startup process at time zero and a time 510, motor controller 112 operates motor 114 at a first, or starting, speed sufficient to cause fan 116 to produce a first mass flow having a first mass flow rate. The first mass flow rate creates a vacuum pressure at vacuum switch 108 that is greater than a threshold vacuum pressure 512 to actuate vacuum switch 108.

During a second period 514 after time 510, motor controller 112 operates motor 114 at a second, or target, speed sufficient to cause fan 116 to induce a second mass flow having a second, or target, mass flow rate. The second mass flow rate is a target mass flow rate for operation of burner 104 and creates a vacuum pressure at vacuum switch 108 that is a corresponding target vacuum pressure 516.

The methods and systems described herein may be implemented using computer programming or engineering techniques including computer software, firmware, hardware or any combination or subset thereof, wherein the technical effect may include at least one of: (a) enabling a constant mass flow fan motor without an airflow sensor to be used in draft inducer for a burner system by initially operating a fan motor at an elevated speed to ensure sufficient airflow is within the system for ignition of the burner before operating the fan motor at a reduced speed to produce a target airflow for normal operation of the burner; (b) reducing the cost of a draft inducer for a burner system by eliminating the need for a fan motor of the draft inducer to have an airflow sensor; and (c) increasing the ease of manufacture and installation of a fan motor for a draft inducer for a burner system by eliminating the need for the fan motor to include an airflow sensor.

Some embodiments involve the use of one or more electronic processing or computing devices. As used herein, the terms "processor" and "computer" and related terms, e.g., "processing device," "computing device," and "controller" are not limited to just those integrated circuits referred to in the art as a computer, but broadly refers to a processor, a processing device, a controller, a general purpose central processing unit (CPU), a graphics processing unit (GPU), a microcontroller, a microcomputer, a programmable logic controller (PLC), a reduced instruction set computer (RISC) processor, a field programmable gate array (FPGA), a digital signal processing (DSP) device, an application specific integrated circuit (ASIC), and other programmable circuits or processing devices capable of executing the functions described herein, and these terms are used interchangeably herein. The above embodiments are examples only, and thus are not intended to limit in any way the definition or meaning of the terms processor, processing device, and related terms.

In the embodiments described herein, a memory device may include, but is not limited to, a non-transitory computer-readable medium, such as flash memory, a random access memory (RAM), read-only memory (ROM), erasable programmable read-only memory (EPROM), electrically erasable programmable read-only memory (EEPROM), and non-volatile RAM (NVRAM). As used herein, the term "non-transitory computer-readable media" is intended to be representative of any tangible, computer-readable media, including, without limitation, non-transitory computer storage devices, including, without limitation, volatile and non-volatile media, and removable and non-removable media such as a firmware, physical and virtual storage, CD-ROMs, DVDs, and any other digital source such as a network or the Internet, as well as yet to be developed digital means, with the sole exception being a transitory, propagating signal. Alternatively, a floppy disk, a compact disc-read only memory (CD-ROM), a magneto-optical disk (MOD), a digital versatile disc (DVD), or any other computer-based device implemented in any method or technology for short-term and long-term storage of information, such as, computer-readable instructions, data structures, program modules and sub-modules, or other data may also be used. Therefore, the methods described herein may be encoded as executable instructions, e.g., "software" and "firmware," embodied in a non-transitory computer-readable medium. Further, as used herein, the terms "software" and "firmware" are interchangeable, and include any computer program stored in memory for execution by personal computers, workstations, clients and servers. Such instructions, when executed by a processor, cause the processor to perform at least a portion of the methods described herein.

Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

This written description uses examples to provide details on the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A motor controller for a burner system including a draft inducer fan configured to draw air through an airflow path through the burner system, and a vacuum switch, said motor controller comprising:

an inverter configured to supply current to a motor configured to rotate the draft inducer fan; and a processor communicatively coupled to said inverter, wherein said processor is configured to:

receive a draft inducer control signal from a system controller;

determine a first mass flow rate based on a target mass flow rate to be generated by the draft inducer, wherein the first mass flow rate is greater than the target mass flow rate;

compute a starting speed based on the first mass flow rate using a mass flow curve;

instruct, in response to the draft inducer control signal, said inverter to supply a first current during a first period to said motor to rotate the draft inducer fan at the computed starting speed to produce a first mass flow through the burner system, the first mass flow having the first mass flow rate; and instruct said inverter to supply a second current, during a second period starting at an expiration of the first period, to said motor to rotate the draft inducer fan to produce a second mass flow through the burner system, the second mass flow having the target mass flow rate for normal operation of the burner.

2. The motor controller of claim 1, wherein the processor is configured to determine the first mass flow rate by multiplying the target mass flow rate by a factor of at least 1.2.

3. The motor controller of claim 1, wherein the mass flow curve is expressed as either a formula or a lookup table stored in a memory.

4. The motor controller of claim 1, wherein the processor is further configured to determine the second mass flow based on the target mass flow rate using a mass flow curve.

5. The motor controller of claim 4, wherein the mass flow curve is expressed as either a formula or a lookup table stored in a memory.

6. The motor controller of claim 1, wherein the first period has a duration of at least 30 seconds.

7. A method of operating a motor for a draft inducer in a burner system, the motor coupled to a draft inducer fan configured to move air though an airflow path of the burner system, said method comprising:

receiving, by a motor controller configured to supply current to the motor, a draft inducer control signal from a system controller;

determine, by the motor controller, a first mass flow rate based on a target mass flow rate to be generated by the draft inducer, wherein the first mass flow rate is greater than the target mass flow rate;

calculating, by the motor controller, a starting speed based on the first mass flow rate using a mass flow curve;

supplying, in response to the draft inducer control signal, a first current, during a first period, to the motor to rotate the draft inducer fan at the calculated starting speed to produce a first mass flow through the burner system, the first mass flow having the first mass flow rate; and supplying a second current, during a second period starting at an expiration of the first period, to the motor to rotate the draft inducer fan to produce a second mass flow through the burner system, the second airflow having a target mass flow rate for normal operation of the burner.

8. The method of claim 7, further comprising determining, by the motor controller, the first mass flow rate by multiplying the target mass flow rate by a factor of at least 1.2.

9. The method of claim 7, wherein the mass flow curve is expressed as one of a formula and a lookup table stored in memory.

10. The method of claim 7, further comprising calculating, by the motor controller, a second speed corresponding to the second mass flow based on the target mass flow rate using a mass flow curve.

11. The method of claim 10, wherein the mass flow curve is expressed as at least one of a formula and a lookup table stored in memory.

12. The method claim 7, wherein the first period has a length of at least 30 seconds.

13. A burner system comprising:

a burner;

a heat exchanger;

a collection manifold;

a motor coupled to and configured to turn a draft inducer fan configured to draw an airflow through an airflow path from said collection manifold and across said burner and through said heat exchanger;

a vacuum switch configured to actuate when a mass flow rate through the airflow path is sufficient to produce a vacuum above a vacuum threshold, thereby enabling operation of said burner; and a motor controller coupled to said motor and configured to:

receive a draft inducer control signal from a system controller;

determine a first mass flow rate based on a target mass flow rate to be generated by the draft inducer, wherein the first mass flow rate is greater than the target mass flow rate; and calculate a starting speed based on the first mass flow rate using a mass flow curve;

operate said motor, during a first period, to rotate said draft inducer fan at the calculated starting speed to produce a first mass flow through the airflow path, the first mass flow having the first mass flow rate; and operate said motor, during a second period starting at an expiration of the first period, to rotate said draft inducer fan to produce a second mass flow through the airflow path, the second mass flow having the target mass flow rate for normal operation of the burner.

14. The burner system of claim 13, wherein the motor controller is further configured to determine the first mass flow rate by multiplying the target airflow rate by a factor of at least 1.2.

15. The burner system of claim 13, wherein the mass flow curve is expressed as one of a formula and a lookup table stored in a memory.

16. The burner system of claim 13, wherein the motor controller is further configured to calculate a second speed based on the target mass flow rate using a mass flow curve.

17. The burner system of claim 16, wherein the mass flow curve is expressed as at least one of a formula and a lookup table stored in a memory.

* * * * *